US005304060A

United States Patent [19]

Lin

[11] Patent Number: 5,304,060

[45] Date of Patent: Apr. 19, 1994

[54] HANDY TORCH

[76] Inventor: Arlo H. T. Lin, No. 5, lane 25, TaTung Rd., Wu Fong Hsiang, Taichung Hsien, Taiwan

[21] Appl. No.: 55,502

[22] Filed: Apr. 30, 1993

[51] Int. Cl.[5] ..... F23Q 7/12

[52] U.S. Cl. ..... 431/255

[58] Field of Search ..... 431/255, 142

[56] References Cited

U.S. PATENT DOCUMENTS 4,292,021 9/1981 Miyagawa ..... 431/255

5,082,440 1/1992 Yamamoto ..... 431/255

5,222,889 6/1993 Hsu ..... 431/255

*Primary Examiner*—Carroll B. Dority

*Attorney, Agent, or Firm*—Pro-Techtor International

[57] ABSTRACT

A handy torch including a holder for accommodating a handy lighter and a torch body detachably mountable on the holder for holding the lighter in the holder, wherein the torch body is consisted of two opposing half shells abutted against each other to define a narrow, horizontal clamping space between vertically spaced clamping strips thereon, in which a heat-insulation partition board is retained to hold a torch nozzle bearing block, the partition board having a rectangular hole for guiding a link mechanism controlled by a firing button to trigger a firing device and a fuel gas flow control push button on the lighter.

4 Claims, 6 Drawing Sheets

HANDY TORCH

BACKGROUND OF THE INVENTION

The present invention relates to a handy torch which uses a disposable lighter as a fuel source.

Various structures of handy torch that use a disposable lighter as a fuel source have been disclosed, and have appeared on the market, exemplar of which is shown in U.S. Pat. No. 5,082,440, issued to Yamamoto. The handy compact torch according to Yamamoto comprises a bottom-closed holder (11) for accommodating a disposable lighter (12) and a torch body (10) detachably mounted on the top of the holder (11). The torch body (11) comprises a cover detachably put on the top of the holder, a head cover mounted on the top of the cover, and a depressible firing button (104) provided at the rear of the cover. A torch nozzle (18) is provided inside the head cover. A firing device (13) is provided under the firing button (104). A piezoelectric device is mounted in the firing device and connected through a lead wire to a spark-emitting unit (19) provided near the tip of the torch nozzle (18). A connecting pipe (17) is provided at the rear end of the torch nozzle and connected to the injection nozzle of the disposable lighter by a connecting tube (16). A link mechanism is secured to the firing button (104) to press the push button (15) of the disposable lighter (12) when the firing button is depressed. The link mechanism comprises a horizontal lever (105) and a vertical rod (106) provided at the front end of the lever (105). A coil spring (107) is put around the rod (104) to allow the upward return of the depressed firing button (104). The torch body comprises a horizontal bearing board (100) in the middle, and a vertical bearing block (101) fastened to the horizontal bearing board (100) to hold the connecting tube, the connecting pipe and the torch nozzle. This structure of handy compact torch is still not satisfactory in use. During the operation of the torch, heat will be transmitted to the soldering device through the horizontal bearing board (100) via the vertical bearing block (101). As the soldering device is heated, it becomes uncomfortable to hold with the hand, and the internal mechanism of the soldering device may be damaged. Another disadvantage of this structure of handy compact torch is that screw holes must be made on the horizontal bearing board and the vertical bearing block for threading tie screws (102; 103) in connecting the horizontal bearing board and the vertical bearing block together. This arrangement complicates the manufacturing and the assembly process of the torch. Further, because there is no support or guide means to guide the reciprocating movement of the vertical rod of the link mechanism, the vertical rod (106) of the link mechanism may be tilted when it is pressed by the horizontal lever (105), and therefore the firing button may have to be pressed several times so that a flow of fuel gas can be released from the disposable lighter.

DETAILED DESCRIPTION OF THE PREFERRED EMBODIMENT

Figure 1:
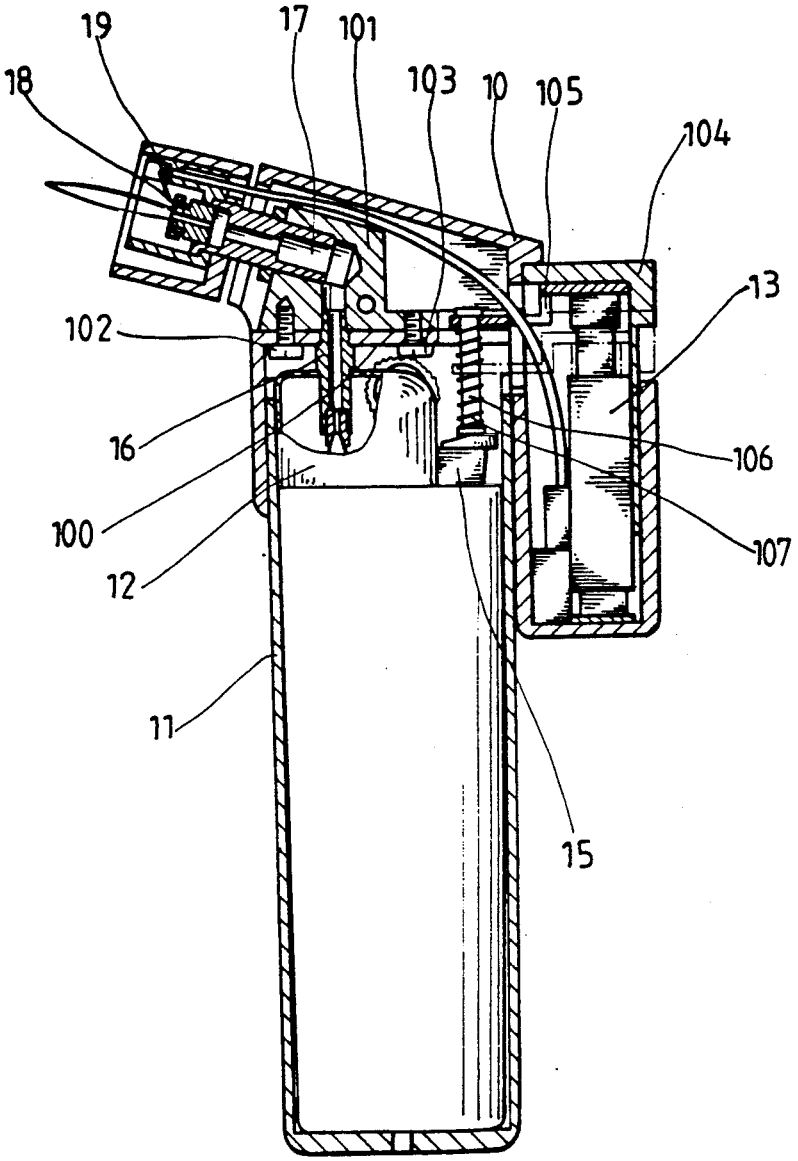
PRIOR ART FIG. 1
FIG. 1 is a vertical sectional view of a handy torch according to the prior art.
Figure 2:
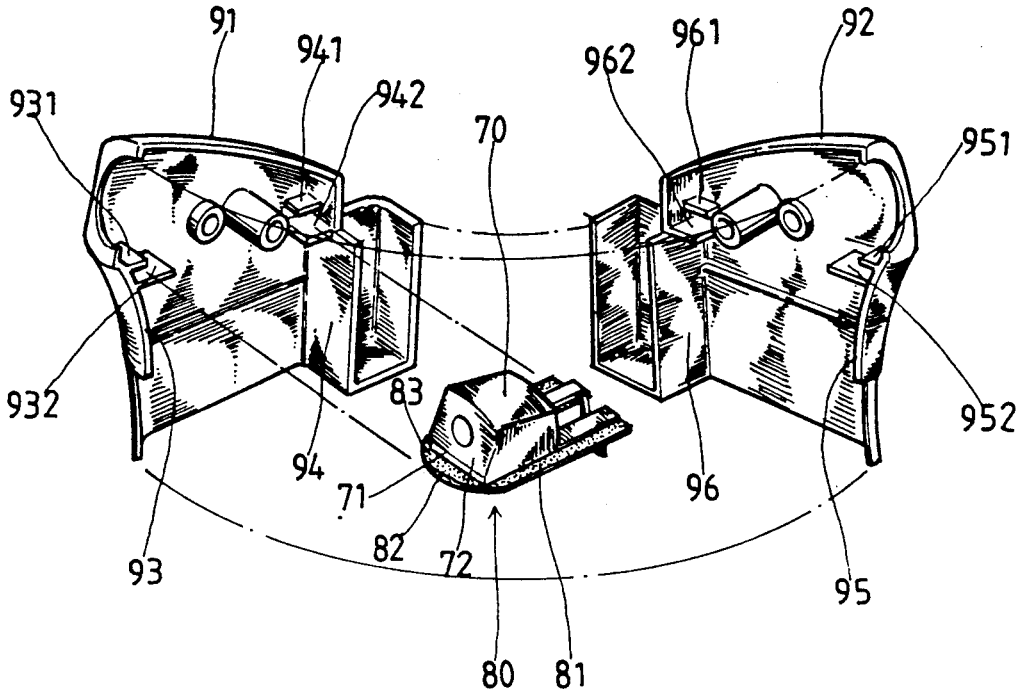
FIG. 2 is an exploded view of a torch body for a handy torch according to the present invention.
Figure 3:
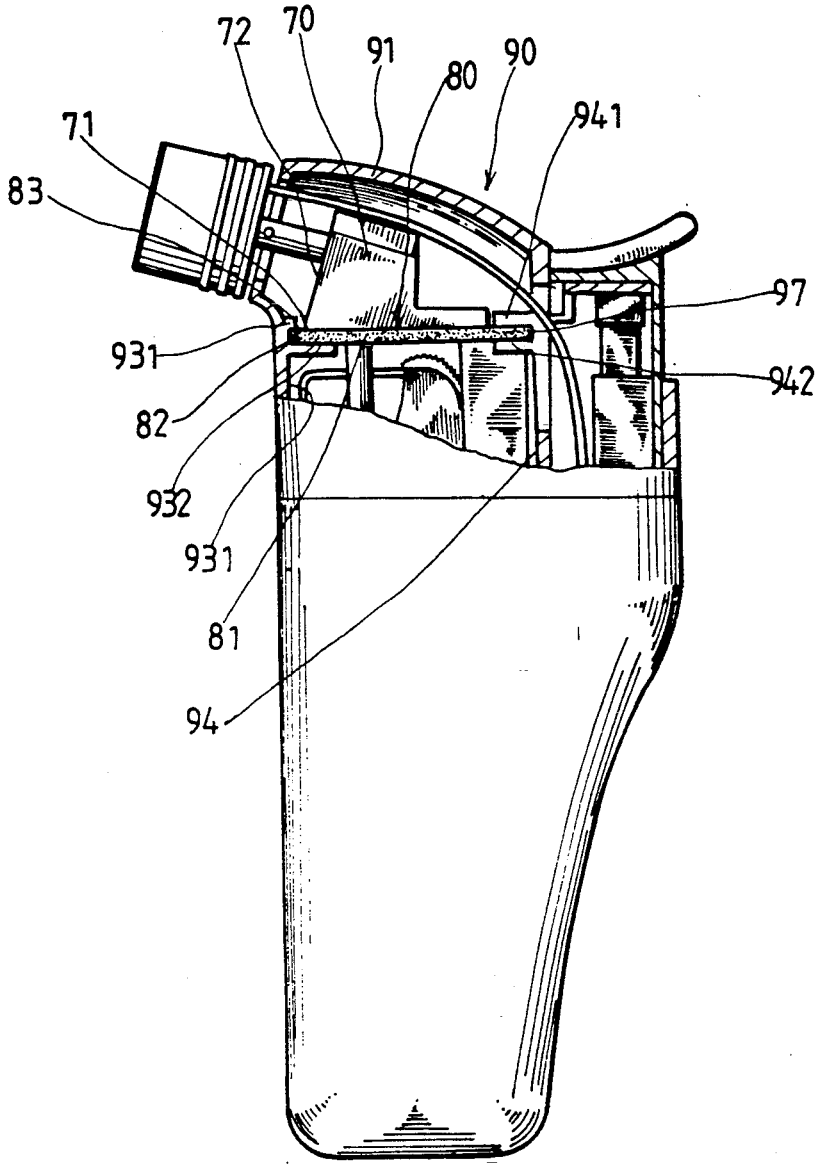
FIG. 3 is a partially cut-away view of a handy torch according to the present invention.

Referring to FIGS. 2 and 3, a torch body 90 is comprised of two opposing half shells, namely, the left half shell 91 and the right half shell 92 respectively made of rigid plastic through an injection molding process. The left half shell 91 has two opposite side walls 93; 94 abutted against respective side walls 95; 96 on the right half shell 92 to define a clamping space 97 (see FIG. 3) between upper clamping strips 931; 941; 951; 961 and lower clamping strips 932; 942. A horizontal partition board 80 is inserted in the clamping space 97 and retained between the upper clamping strips 931; 941; 951; 961 and the lower clamping strips 932; 942; 952; 962. A torch nozzle bearing block 70 is provided above the horizontal partition board 80. The horizontal partition board 80 is made from a suitable heat insulation material in a flat configuration having a smaller thickness than the pitch of the clamping space. The horizontal partition board 80 comprises an arched portion 82 on one end of a flat, rectangular body 81 thereof. The torch nozzle bearing block 70 is mounted on the flat, rectangular body 81 of the horizontal partition board 80 at the top for holding a torch nozzle, having a bottom edge 71 on a sloping front end 72 thereof spaced from the arched portion 82 by a surface 83. When installed, the surface 83 of the horizontal partition board 80 is retained between upper clamping strips 931; 951 and lower clamping strips 932; 952, and the flat, rectangular body 81 of the horizontal partition board 80 is retained between upper clamping strips 941; 961 and lower clamping strips 942; 962. Further, the projecting lengths of the clamping strips are determined according to the width of the torch nozzle bearing block 70.

Figure 4:
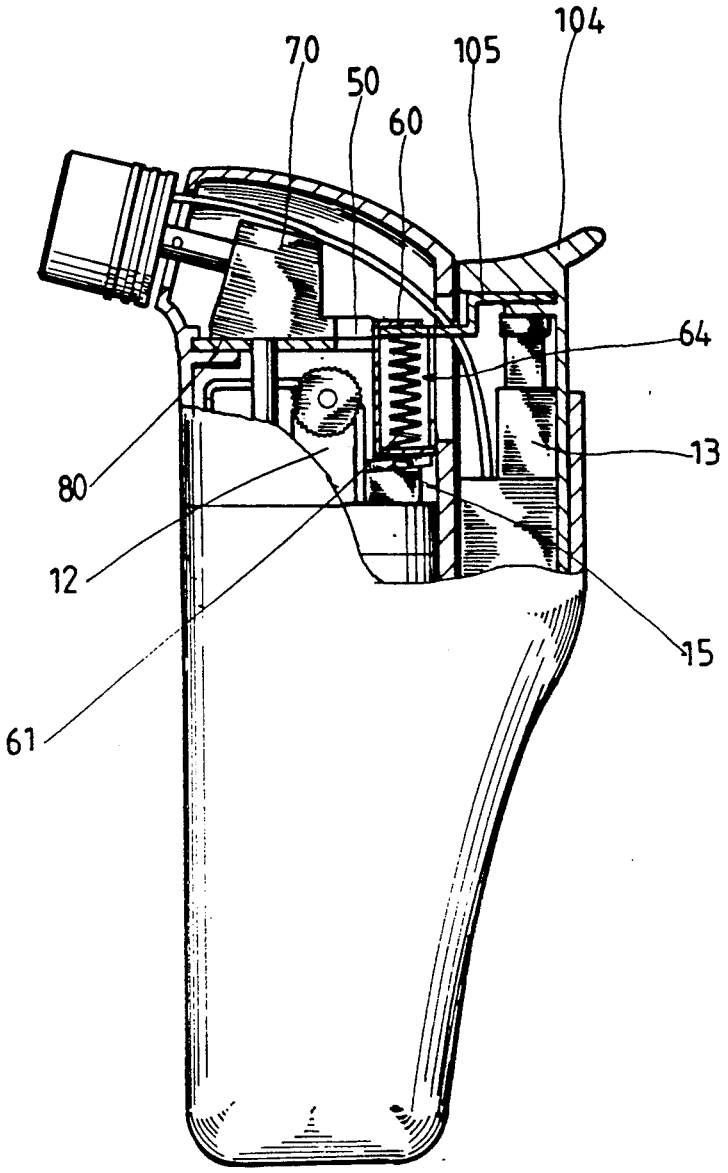
FIG. 4 is another partially cut-away view of the handy torch of the present invention showing the arrangement of the link mechanism.
Figure 5:
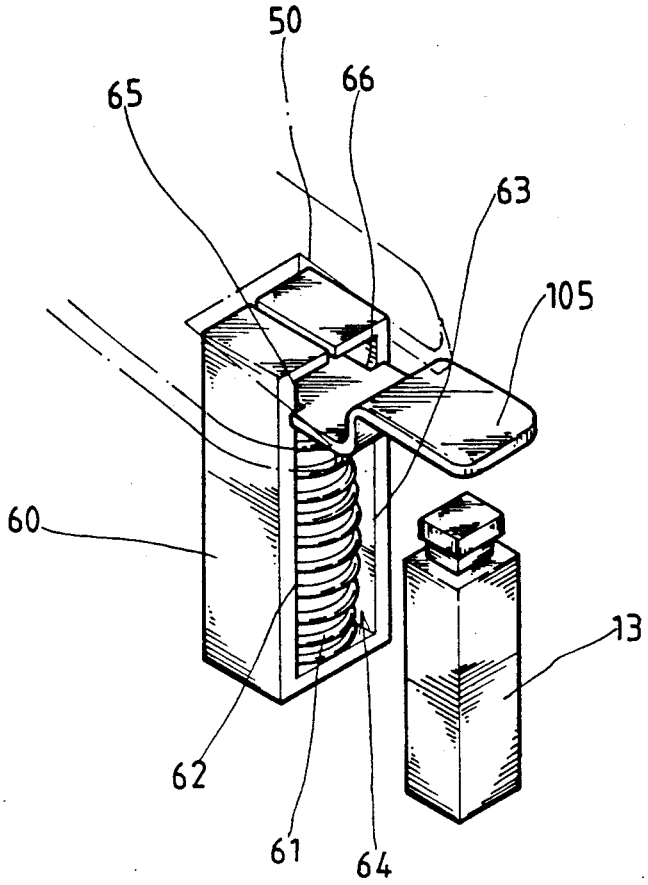
FIG. 5 is a perspective view of the link mechanism and the firing device.

Referring to FIGS. 4 and 5, a rectangular through hole 50 is made through the horizontal partition board 80 which receives a link mechanism. The link mechanism comprises a rectangular casing 60 having a front opening 64 defined within two opposite, vertical side walls 62; 631, a coil spring 61 retained inside the casing 60, and a horizontal lever 105 having one end inserted in the casing 60 above the coil spring 61, two opposite angle edges 65; 66 respectively stopped at the side walls 62; 63, and an opposite end fastened to the firing button 104 at the bottom above a firing device 13.

Figure 6:
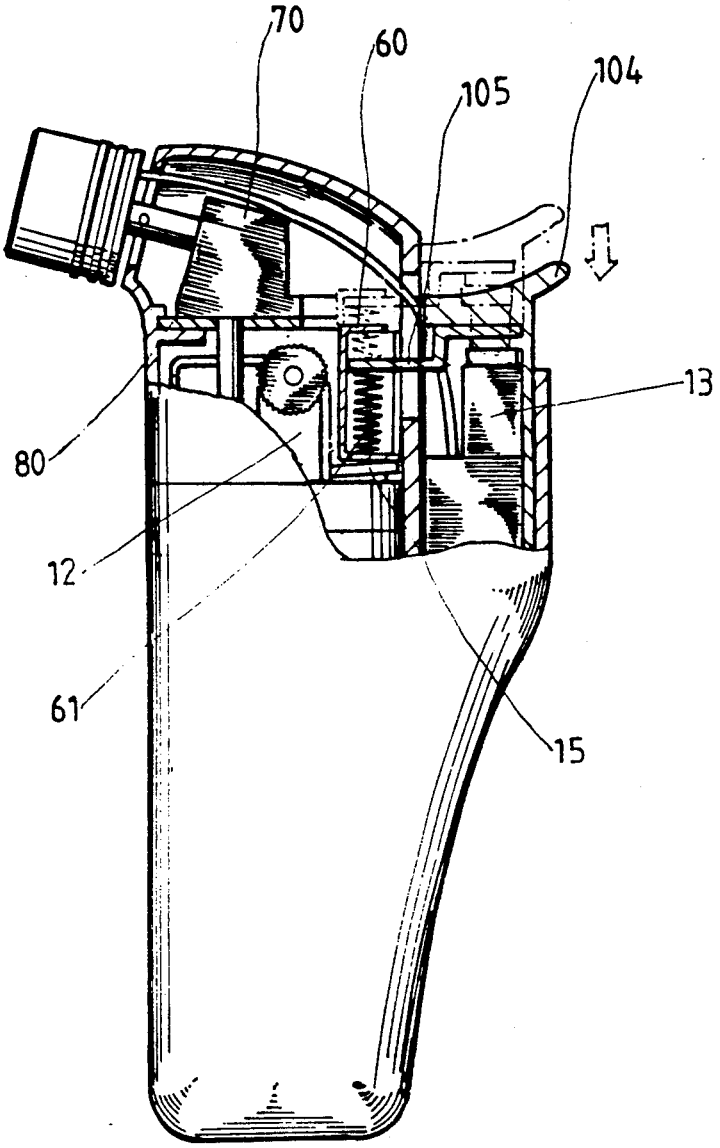
FIG. 6 is similar to FIG. 4 but showing the firing button pressed.

Referring to FIG. 6 and FIG. 4 again, by depressing the firing button 104, the push button 15 of the disposable lighter 12 in the holder 11 is pushed down through the link mechanism, i.e. the lever 105 and the casing 60, thus allowing the fuel gas in the gas container of the lighter 12 to be fed discharged through a connecting pipe and a torch nozzle.

Because the torch nozzle bearing block 70 is isolated from the torch body 90 and supported on the heat-insulation partition board 80, heat is isolated from transmitting to the torch body 90. Because the partition board 80 is fastened to the torch body 90 by engaging the arched portion 82 and the rectangular body 81 into the clamping space 97, the assembly-process of the torch is simple, and the torch can be conveniently disassembled for a repair work. Further, because the casing 60 of the link mechanism is inserted in the rectangular through hole 50 on the partition board 80, the reciprocating movement of the casing 60 is stable.

What is claimed is:

1. A torch apparatus comprising a holder adapted to accommodate a lighter therein and a torch body detachably mountable on said holder for holding the lighter in said holder, wherein said torch body is comprised of two opposing half shells abutted against each other to define a narrow, horizontal clamping space between vertically spaced clamping strips thereon, in which a heat-insulation partition board is retained to hold a torch nozzle bearing block.

2. The torch apparatus of claim 1 wherein said vertically spaced clamping strips respectively and horizontally extend from said two opposing half shells at lengths according to the size of said torch nozzle bearing block for not to hinder the installation of said torch nozzle in said partition board.

3. The torch apparatus of claim 1 wherein said partition board comprises an arched portion at one end of a flat rectangular body thereof spaced from said torch nozzle bearing block by a horizontal surface for engaging into said clamping space.

4. The torch apparatus of claim 1 said partition board comprises a rectangular through hole which receives a link mechanism, said link mechanism being controlled by a firing button to trigger a firing device and a fuel gas flow control push button on the lighter for making a fire, said link mechanism comprising a rectangular casing having a front opening defined within two opposite, vertical side walls thereof, a coil spring retained inside said casing, and a horizontal lever having one end inserted in said casing and supported above said coil spring, two opposite angle edges respectively stopped at the two opposite vertical side walls of said rectangular casing, and an opposite end fastened to a firing button at the bottom above a firing device.

* * * * *